US008201807B2

(12) United States Patent
Hernandez, Jr.

(10) Patent No.: US 8,201,807 B2
(45) Date of Patent: Jun. 19, 2012

(54) JACK STAND AND COMBINATION AND METHOD OF ELEVATING A LOAD

(75) Inventor: Hector Ray Hernandez, Jr., Fullerton, CA (US)

(73) Assignee: Alltrade Tools LLC, Long Beach, CA (US)

( * ) Notice: Subject to any disclaimer, the term of this patent is extended or adjusted under 35 U.S.C. 154(b) by 0 days.

(21) Appl. No.: 13/333,853

(22) Filed: Dec. 21, 2011

(65) Prior Publication Data

US 2012/0112147 A1 May 10, 2012

Related U.S. Application Data

(63) Continuation-in-part of application No. 12/100,385, filed on Apr. 9, 2008, now abandoned, which is a continuation of application No. 11/286,788, filed on Nov. 23, 2005, now abandoned.

(51) Int. Cl.
*B66F 3/24* (2006.01)
*B66F 3/42* (2006.01)

(52) U.S. Cl. ..... 254/93 H; 254/133 R; 254/134

(58) Field of Classification Search ..... 254/93 H, 254/133 R, 134
See application file for complete search history.

(56) References Cited

U.S. PATENT DOCUMENTS 1,964,003 A 6/1934 McBride
2,529,292 A * 11/1950 Greenfield ..... 248/354.6
3,047,269 A 7/1962 Renshaw
3,802,658 A 4/1974 Binding
3,970,278 A 7/1976 Studer
3,989,276 A 11/1976 Hamerl
4,165,861 A 8/1979 Hanser
4,238,113 A 12/1980 Adams
4,245,808 A 1/1981 John
4,479,634 A * 10/1984 Blatz ..... 254/133 R
4,540,147 A 9/1985 Lincourt
4,635,904 A 1/1987 Whittingham
4,662,610 A 5/1987 Cofer
4,811,924 A 3/1989 Walters
4,856,747 A 8/1989 Gano
4,919,392 A 4/1990 Minuto
5,009,394 A 4/1991 Marshall
5,180,131 A 1/1993 Few
5,348,330 A 9/1994 Few et al.
5,358,217 A 10/1994 Dach
5,423,518 A 6/1995 Baxter et al.
5,490,656 A 2/1996 Frisby
5,497,969 A 3/1996 Broughton
5,501,428 A 3/1996 Garceau
5,901,935 A 5/1999 Lai
5,915,672 A 6/1999 Dickey
6,019,337 A 2/2000 Brown
6,029,950 A 2/2000 Yeh
6,062,524 A 5/2000 Jackson, Sr.
6,145,813 A 11/2000 Anderson
6,224,102 B1 5/2001 Nebel
6,322,062 B1 11/2001 Conn et al.
(Continued)

*Primary Examiner* — Lee D Wilson
*Assistant Examiner* — Shantese McDonald
(74) *Attorney, Agent, or Firm* — Fulwider Patton LLP

(57) ABSTRACT

The combination of a jack stand and a vertically oriented, compact hydraulic jack enables a user to avoid misplacement when lifting a load. The stand includes a vertically oriented column moveable between a plurality of different elevated positions. An underside of an overhanging member attached to the column is engaged by a piston member of the jack to elevated the column as the jack is elevated.

4 Claims, 15 Drawing Sheets

U.S. PATENT DOCUMENTS

| | | | |
|---|---|---|---|
| 6,446,937 | B1 | 9/2002 | Straw, Sr. et al. |
| 6,517,112 | B1 | 2/2003 | Watkins |
| 6,612,533 | B2 | 9/2003 | Biles et al. |
| 6,641,115 | B1 | 11/2003 | Bainter |
| 6,644,615 | B1 | 11/2003 | Liu |
| 6,722,635 | B2 | 4/2004 | Erickson |
| 6,726,236 | B2 | 4/2004 | Cofer |
| 6,902,148 | B1 | 6/2005 | Spencer |

* cited by examiner

JACK STAND AND COMBINATION AND METHOD OF ELEVATING A LOAD

CROSS-REFERENCES TO RELATED APPLICATIONS

This application is a continuation-in-part of co-pending application Ser. No. 12/100,385 filed on Apr. 9, 2008; which is a continuation of U.S. Ser. No. 11/286,788, filed on Nov. 23, 2005 which was Abandoned on Jul. 29, 2008.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular" includes square.

BACKGROUND OF INVENTION

Hydraulic jacks are used to raise many types of loads above ground level such as, for example, automobiles. If the jack remains in place after elevating a load, over time due to leakage of hydraulic fluid, the jack gradually lowers the load. The best practice is to use a jack stand placed under the load to maintain the load elevated and remove the jack once the jack stand is in place.

A problem occurs in connection with lifting automotive vehicles having a uni-body frame that frequently is bent when the jack is improperly positioned beneath the vehicle. Moreover, even if the jack is placed properly beneath the frame at a position that avoids bending the frame, the jack stand is often placed beneath the frame at an improper position, resulting in the frame bending under the weight of the vehicle when the jack in lowered. Placing the jack stand next to the elevated jack is no guarantee that it is correctly position to avoid bending the frame when the jack is lowered.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to, providing: (a) a jack stand and method that enables the jack stand to be precisely located with respect to an automotive vehicle frame so the frame does not bend under the weight of the vehicle when the jack in lowered, (b) a jack stand enabling a plurality of such stands to be stacked one upon another, (c) an especially configured jack stand facilitating its manufacture from metallic sheet material using conventional metal punching, bending and welding techniques, (d) a jack stand that enables several stand to be stacked one upon the other, and (e) a jack stand that may be folded to reduce its size for storage.

Without limiting the scope of this invention as expressed by the claims that follow, some, but not necessarily all, of its features are:

One, this invention includes the combination of a jack stand and jack where the jack stand has a moveable, elongated column that is elevated as the jack is elevated. A vertically oriented, compact hydraulic jack may be used. The column is vertically oriented and moveable between a plurality of different elevated positions. The column may have an overhanging member and the stand may have a platform beneath the overhanging member. The jack is placed on the platform and positioned to elevate the column as the jack is elevated.

Two, the spatial relationship between the column in a completely lowered position and the vertical height of the jack with its piston in a completely lowered position are another feature of this invention. Under these conditions the underside of the overhanging member of the column is above a top side of the platform a predetermined distance substantially equal to the vertical height of the jack with its piston in a completely lowered position. Thus, a head end of the jack's piston engages this underside, simultaneously raising the column as the jack is elevated. When the pin element is in place holding the jack in a selected elevated position, the jack may be lowered and removed from the platform.

Three, the support column is held in a selected one of plurality of different elevated positions after being elevated by the hydraulic jack and upon removal of the hydraulic jack from the platform. Different means may be used to hold the raised column in a selected elevated position. One means is that the support column may include a series of pairs of aligned, opposed openings spaced apart along the support column and a removable pin element is inserted though opposed opening when the selected elevated position is attained. Another means is a ratchet mechanism that holds the support column in a selected one of plurality of different elevated positions.

Four, the column may be detachable and may have a substantially rectangular shape. The column may have at the upper end a locator member with a longitudinal centerline of the stand intersecting a center of the locator member. The locator member may be substantially at a right angle to both the column and a plate member forming the overhanging member and the plate member may be at a right to the column. The locator member may have a central element with opposed ends and a pair of opposed outwardly and upwardly extending flange members, each one connected to one of the ends of the central element.

Five, the stand may comprise a base and a receptacle. The base has one or more of the following characteristics. It may have a substantially pyramid configuration. It may include at or near a bottom end a jack platform and at a top end the receptacle, which may be hollow and have an open upper end. It may have a longitudinal centerline and the receptacle is oriented lengthwise along the centerline. It may have a hollow interior and a partially open side providing access to the interior, enabling the jack to be seated on the platform with the jack at least partially positioned within the interior and its piston member directly under the overhanging member of the column. It may comprise a pair of sections, with the sections being moveable relative to each other to increase and decrease the height of the base. These sections may be substantially mirror images of each other and they may be attached at upper ends thereof to pivot. Bracing structure extending between lower ends of the sections may be used to increase the rigidity of the base.

Six, the receptacle may be fixedly attached to the base of the jack stand or it may be a separate detachable member. The receptacle may have dimensions substantially the same as the dimensions of the column to enable the lower end of the column to be inserted into the open upper end of the receptacle. For example, the receptacle and the column may each be of substantially the same rectangular in cross-sectional configuration. The receptacle may include a pair of aligned, opposed openings that enable the removable pin element to be inserted into one opening in the receptacle and through the openings in one pair of the series in the column aligned with the openings in the receptacle and through the other opening in the receptacle. With the pin element so inserted, it maintains the column in a selected elevated position.

These features are not listed in any rank order nor is this list intended to be exhaustive.

This invention also includes a method of lifting a load. This method comprises the steps of (a) positioning beneath the load at a predetermined location relative to the load a jack stand including a vertically oriented column moveable between a plurality of different elevated positions and having an overhanging member, (b) positioning a vertically oriented, compact hydraulic jack next to the stand beneath the overhanging member, (c) actuating the jack to elevate its piston member so that said piston member engages an underside of the overhanging member and elevates the column as the jack is elevated to bring an upper end of the column into contact with the load, (d) holding the column in a selected elevated vertical position and lowering the piston member so that the weight of the load is supported by the stand.

In a further embodiment, the invention includes a jack stand in combination with a hydraulic jack comprising a jack stand having a platform for providing stable support to the base, a base attached to the platform, the base defining a receptacle configured to slidingly receive a column, and a column having an upper end and a lower end, the lower end slidingly received within the receptacle. A locator member is provided for precise location under an object to be lifted, the locator member being attached to the upper end of the column and including a first planar horizontal surface for contact with the object to be lifted. A plate member is connected to the upper end of the column, the plate member extending substantially at a right angle to the column and including a second planar horizontal surface for contact with the object to be lifted. An important feature of this embodiment is that the first planar horizontal surface is substantially co-planar with the second planar horizontal surface. The embodiment further includes a hydraulic jack positioned on the platform, the hydraulic jack having an elongate piston movable upwardly in relation to the hydraulic jack for elevating a load, the piston having a terminal end. The hydraulic jack is positioned adjacent the jack stand such that the elongate piston is positioned alongside of and parallel with the elongate column. The terminal end of the piston is positioned in contact with a lower surface of the plate member, whereby, when the piston is moved upwardly under a load in relation to the hydraulic jack, the plate member is moved upwardly to elevate the load, the column is moved upwardly, and the locator member is moved upwardly in unison with the plate member. Further, the jack stand further includes a means for mechanically holding the column in a selected one of a plurality of different elevated positions in relation to the base. Additionally, the hydraulic jack is removable from the platform when the column is being held in an elevated position by the means for mechanically holding the column.

In a preferred aspect, the means for mechanically holding the column in relation to the base includes a pin manually insertable into aligned holes in the base and in the column. In an alternative preferred aspect, the means for mechanically holding the column in relation to the base includes a ratchet mechanism having teeth on the column configured to engage a pawl mounted on the base.

These and other advantages of the invention will become apparent when read in conjunction with the drawings and the detailed description of the preferred embodiments.

DESCRIPTION OF THE DRAWINGS

Some embodiments of this invention, illustrating all its features, will now be discussed in detail. These embodiments depict the novel and non-obvious jack stand and jack combination and method of this invention as shown in the accompanying drawing, which is for illustrative purposes only. This drawing includes the following figures (Figs.), with like numerals indicating like parts:

FIG. 9 is a perspective view of the jack stand shown in FIG. 8 at a lower position with its sections spread apart and their lower ends attached by a pair of braces.

FIG. 10 is a perspective view of the jack stand shown in FIG. 8 at a higher elevation than that shown in FIG. 9 and lower ends of the sections not separated.

FIG. 11 is a perspective view of the jack stand shown in FIG. 8 with its column elevated the same as shown in FIG. 10 and the sections of the stand moved into a position intermediate that shown in FIGS. 10 and 12.

FIG. 12 is a perspective view of the jack stand shown in FIG. 8 with its column elevated the same as shown in FIGS. 10 and 11 and the sections of the stand moved into a position of maximum separation.

FIG. 13 is a perspective view looking a rear side of a jack stand and jack combination utilizing a ratchet mechanism to raise and lower the column of the jack stand.

FIG. 14 is a perspective view looking a rear side of the jack stand and jack combination shown in FIG. 13.

FIG. 15 is a side view of the jack stand and jack combination shown in FIG. 13.

FIG. 16 is a fragmentary view showing the ratchet mechanism of the jack stand and jack combination shown in FIG. 13.

DETAILED DESCRIPTION OF SOME EMBODIMENTS OF THIS INVENTION

General

Figure 1:
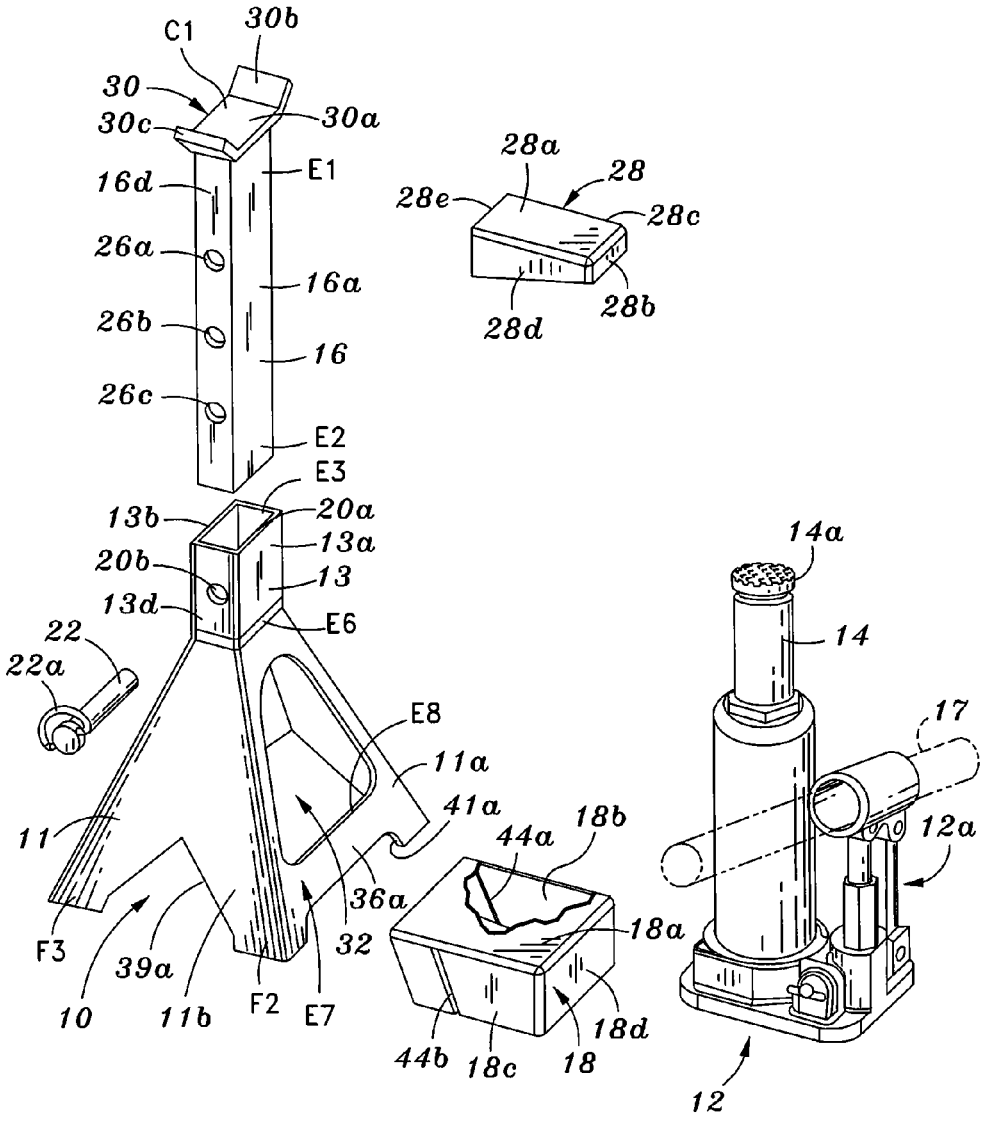
FIG. 1 is an exploded perspective view, with a section of the platform broken away, of the jack stand and jack combination of one embodiment of this invention.

This invention comprises a unique jack stand used with a conventional hydraulic jack, for example, a bottle jack 12. There are several embodiments of the jack stand illustrated, namely, the jack stand 10 shown in FIGS. 1 through 7, the jack stand 10*a* shown in FIGS. 8 through 12, and the jack stand 10*b* shown in FIGS. 13 through 16. In the embodiments illustrated, each stand includes a elongated support column 16, a plate member 28 substantially at a right angle to the column at an upper end of the column, and a base 11 including at or near a bottom end a jack platform 18 and at a top end a hollow receptacle 13 having an open upper end into which the support column is inserted during use. The base 11 may have a rigid, one piece a substantially pyramid configuration as illustrated in the embodiments shown in FIGS. 1 through 7 and FIGS. 13 through 16. Or, the base 11 may have a foldable, two-piece substantially pyramid configuration as illustrated in the embodiment shown in FIGS. 8 through 12.

The support column 16 is moveable lengthwise while positioned within the receptacle 13, and the hydraulic jack 12 is adapted to sit on the platform 18. The hydraulic jack 12 includes a piston 14 having an upper end that is beneath the plate member 28 when the jack 12 is sitting on the platform 18. The piston 14 elevates the column 16 as the piston 14 is raised by manually actuating the jack 12. Upon removal of the hydraulic jack 12 from the platform 14, the support column 16 is held in a selected one of plurality of different elevated positions. This may be accomplished by means of a pin element 22 used in the embodiments depicted in FIGS. 1 through 7 and FIGS. 8 through 12, or a ratchet mechanism 60 used in the embodiment depicted in FIGS. 13 through 16.

FIGS. 1 through 7

As illustrated in FIG. 1, the jack stand 10 of this invention is used with the bottle jack 12. The bottle jack 12 is compact and normally operated in a vertical orientation. Its hydraulically actuated piston 14 elevates a load in response to operating its piston raising and lowering mechanism 12*a* by manually manipulating its detachable handle 17 shown in dotted lines in FIG. 1. A head end 14*a* of the piston 14 has a knurled surface.

The stand 10 includes the base 11, the receptacle 13, the elongated support column 16 received within the receptacle, and the jack platform 18 for supporting the bottle jack 12 in an upright, vertical orientation. The receptacle 13 has a substantially rectangular cross-sectional shape formed by opposed front side 13*a* and back side 13*b* (FIG. 6), and a right hand side 13*c* as viewed in FIG. 6 and a left hand side 13*d* as viewed in FIG. 5. It includes an opening 20*a* in the right side 13*c* and an opening 20*b* (FIG. 1) in the left side 13*d* that are aligned and opposed to each other. The removable pin element 22, which has a grip ring 22*a* at one end, holds the support column 16 in a selected elevated position.

Figure 2:
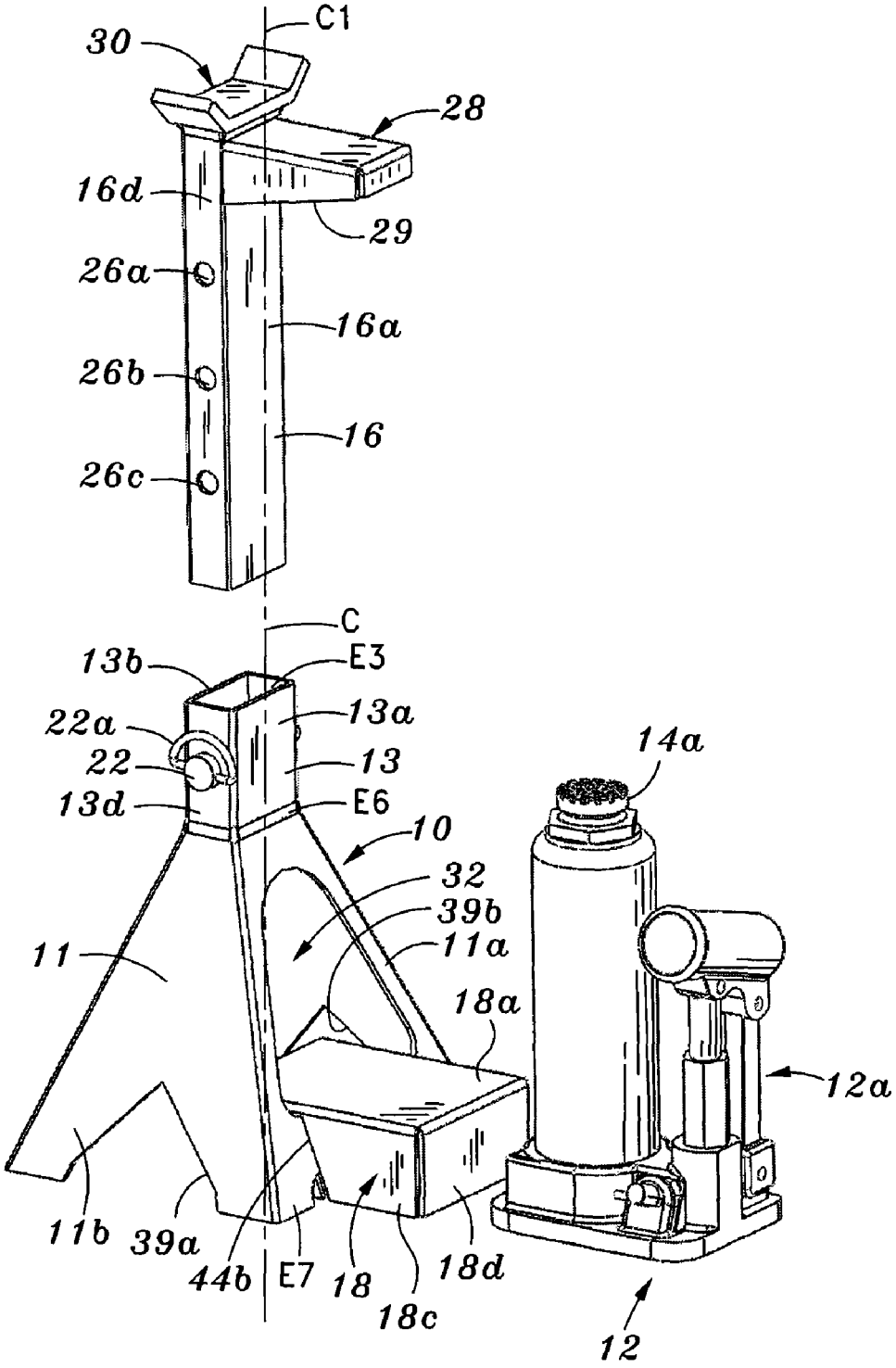
FIG. 2 is a perspective view of the jack stand shown in FIG. 1, with a section of the plate member broken away and partially assembled with its support column aligned to be inserted into an upper open end the stand's receptacle, and the jack next to the stand's platform.
Figure 3:
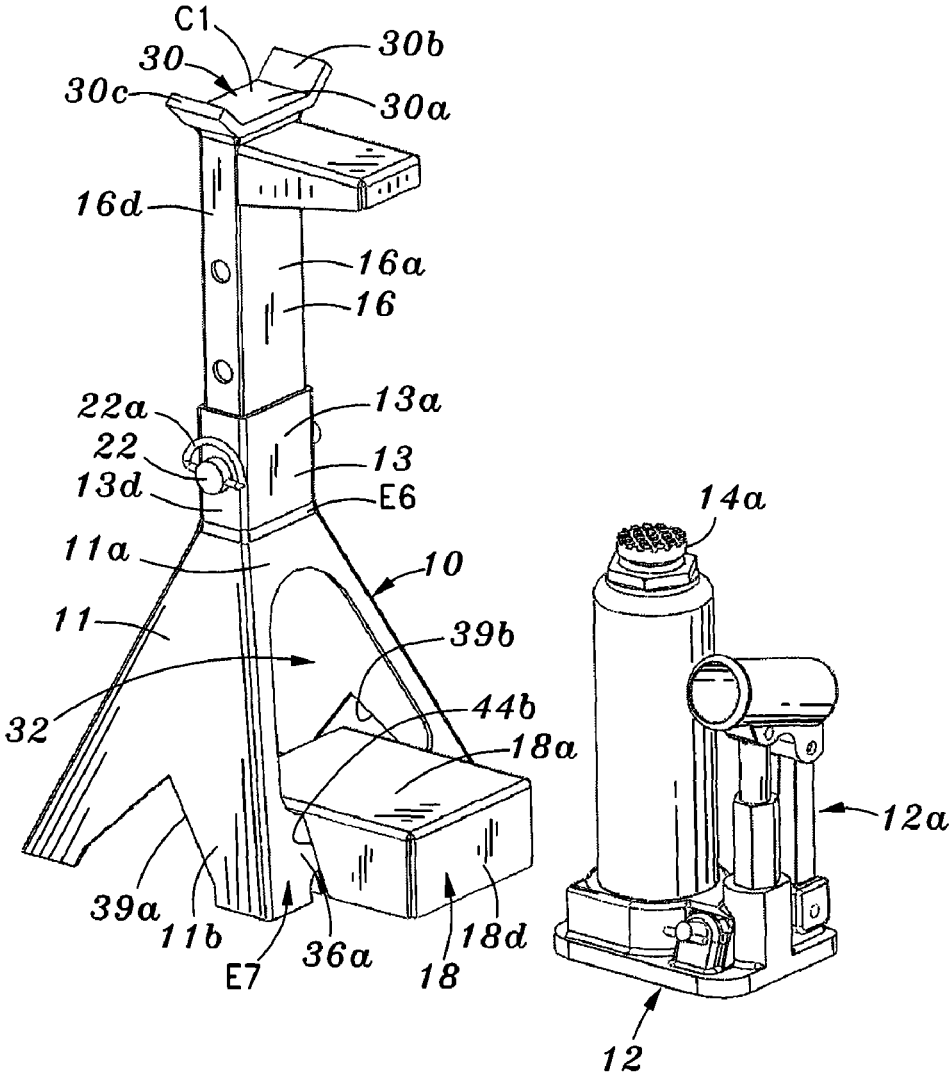
FIG. 3 is a perspective view of the jack stand shown in FIG. 1, completely assembled with its support column inserted into the upper open end of the stand's receptacle and in a completely raised position, and the jack next to the stand's platform.
Figure 6:
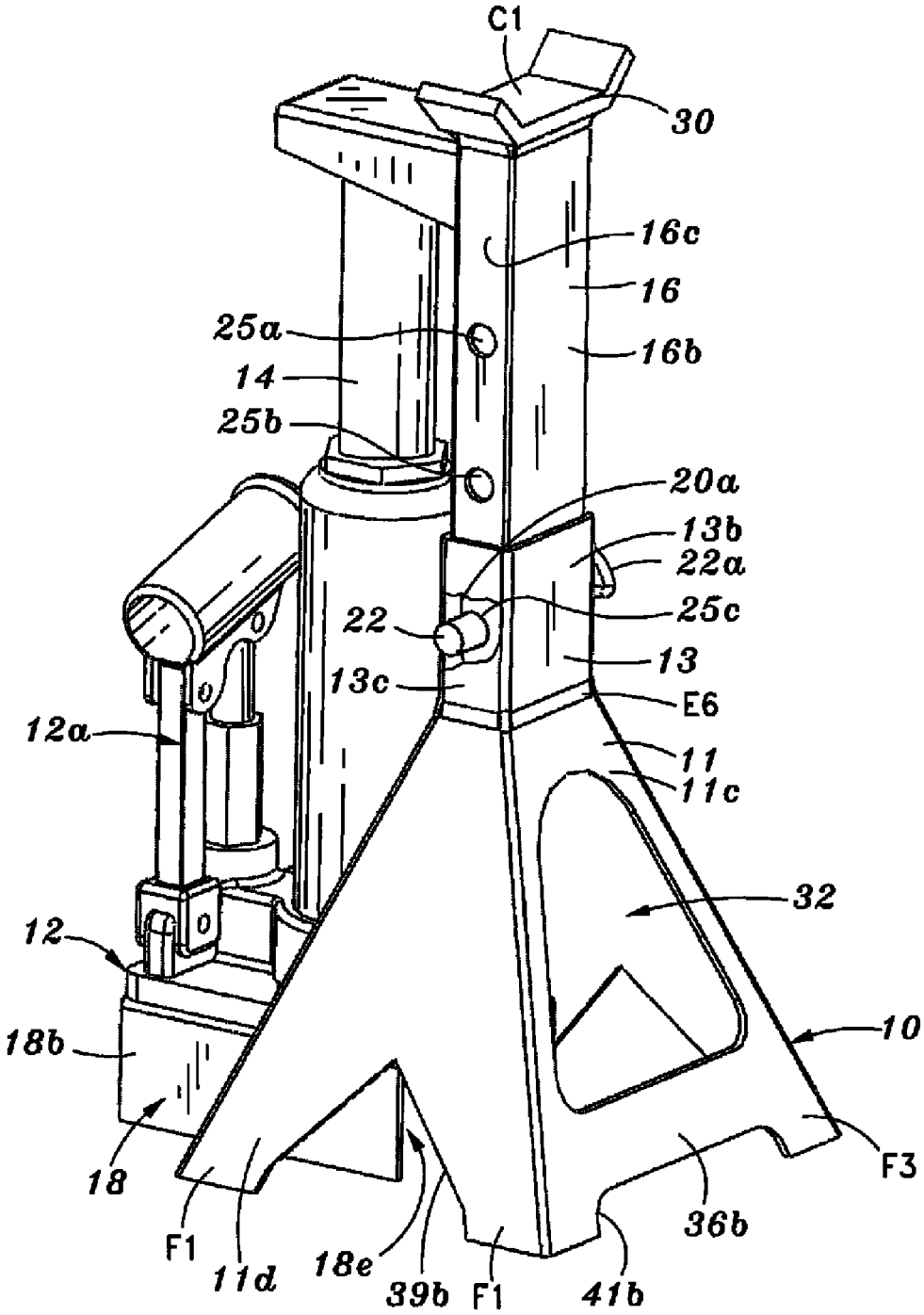
FIG. 6 is a rear perspective view of the jack stand and elevated jack as shown in FIG. 5.

The support column 16 is detachable and has a substantially rectangular cross-sectional shape formed by opposed front side 16*a* and back side 16*b* (FIG. 6), and a right hand side 16*c* as best viewed in FIG. 6 and a left hand side 16*d* as best viewed in FIG. 2. There are openings 25*a*, 25*b*, and 25*c* equally spaced lengthwise along the right hand side 16*c* and openings 26*a*, 26*b*, and 26*c* equally spaced lengthwise along the left hand side 16*d*. This arrangement provides a series of pairs 25*a*-26*a*, 25*b*-26*b*, and 25*c*-26*c* of aligned, opposed openings spaced apart along the opposed sides 16*c* and 16*d* of the support column 16 between an upper end E1 and a lower end E2 of the column. The cross-section dimensions of the receptacle 13 and the column 16 are substantially the same, with the cross-section dimensions of the column being slightly less. This enables the lower end E2 of the column 16 to be inserted into an open upper end E3 (FIGS. 1 and 2) of the receptacle 13 in a male-female mating relationship.

Figure 5:
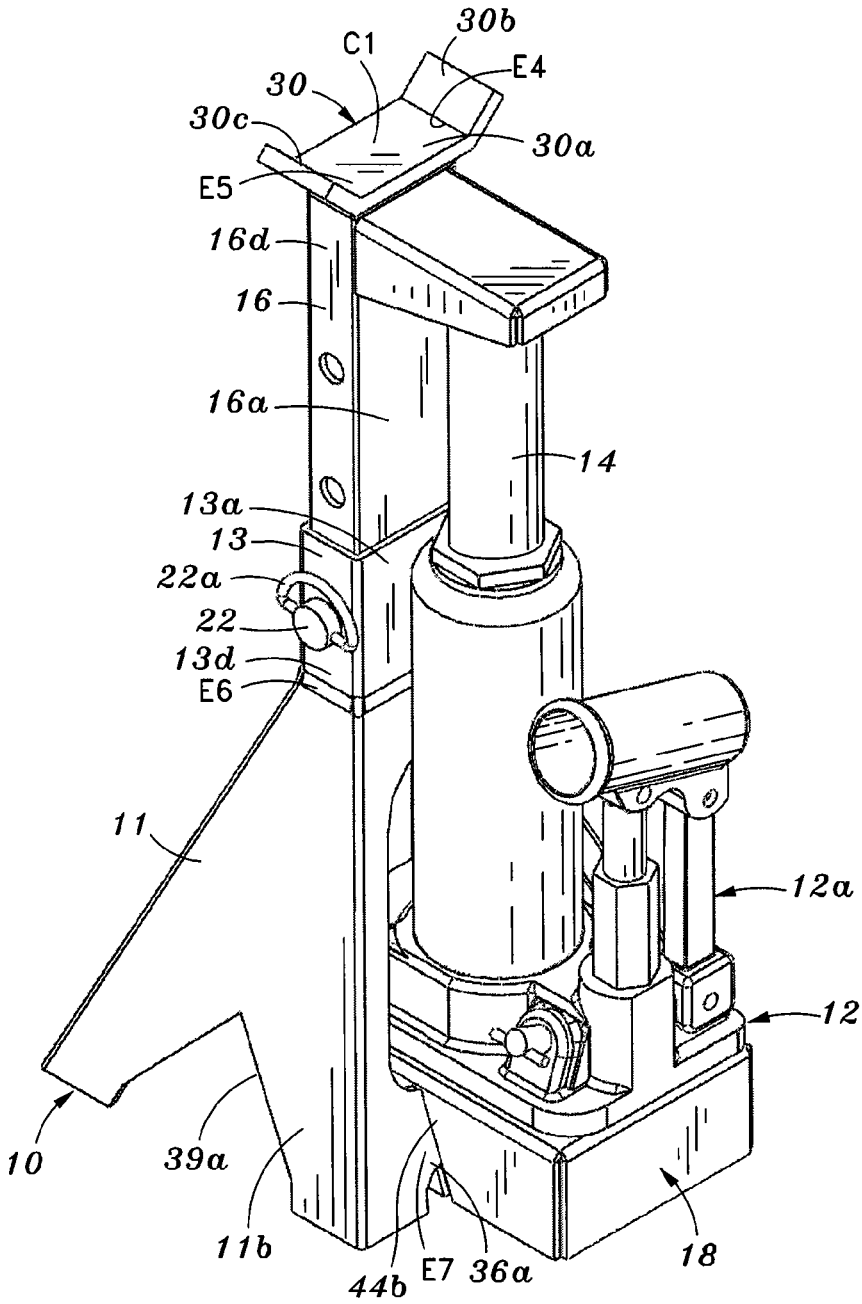
FIG. 5 is a front perspective view of the jack stand shown in FIG. 1 with the jack on the platform and its piston raised to elevate the support column.

The load supporting plate member 28 is attached to the column 16 in a manner to overhang the platform 18. This plate member 28 has an upper substantially flat top 28*a* with a flat underside 29 (FIG. 2) and downwardly extending sides 28*b*, 28*c*, 28*d*, and 28*e* that are substantially at a right angle to the flat top and underside. The column's rear side 28*e* is welded to the front side 16*a* of the column 16 at the upper end E1 substantially at a right angle to the column. The column 16 has at the upper end E1 a locator member 30 welded to this end. The locator member 30 is at substantially a right angle to the plate member 28 and is substantially concave or U-shape to better engage a frame of an automotive vehicle or other object being lifted. A longitudinal centerline C (FIG. 2) of the stand 10 intersects the center C1 of the locator member 30 when the column 16 is inserted into the receptacle 13. As best shown in FIG. 5, the locator member 30 has a central element 30*a* with opposed ends E4 and E5 and a pair of opposed outwardly and upwardly extending flange members 30*b* and 30*c*. Each flange member is integral with the ends of the central element 30*a*.

The base 11 has a substantially pyramid configuration and a longitudinal centerline coincident with the centerline C that intersects a truncated apex end E6. Four flat inwardly slanting, substantially triangular configured sides 11*a*, 11*b*, 11*c* (FIG. 6), and 11*d* (FIG. 6) form a hollow interior 32. The receptacle 13 is welded to the apex end E6 and oriented lengthwise along the centerline C and centrally positioned with respect to the centerline. The opposed sides 11*a* and 11*c* each have central triangular cut-a-way 34*a* and 34*c*, providing, respectively, lower wall sections 36*a* and 36*b* (FIG. 6). As discussed subsequently in greater detail, the central triangular cut-a-ways 34*a* and 34*c* provide access to the interior 32. Substantially inverted V-shaped cut-a-ways 39*a* and 39*b* are respectively in the opposed triangular configured sides 11*b* and 11*d* (FIG. 6), and substantially inverted U-shaped cut-a-ways 41*a* and 41*b* (FIG. 6) are respectively in the opposed triangular configured sides 11*a* and 11*c*. These cut-a-ways 39*a* and 39*b* and 41*a* and 41*b* form foot elements F1, F2, F3, and F4 (FIG. 6) at the bottom corners of the base 11.

The jack platform 18 is at or near a bottom end E7 of the base and it includes a flat top side 18*a*, a right side 18*b* as viewed in FIG. 6, a left side 18*c*, a front side 18*d*, and an open rear side 18*e* (FIG. 6). The sides 18*b*, 18*c*, and 18*d* are substantially at a right angle to the flat top side 18*a*. A pair of upwardly and inwardly slanted aligned slots 44*a* (FIGS. 1) and 44*b* respectively in the sides 18*b* and 18*c* enable the jack platform 18 to be mounted to the lower wall sections 36*a* or 36*b* (FIG. 6) of the base 11, as the case may be. An upper edge E8 of the lower wall sections 36*a* or 36*b*, as the case may be, slides into the aligned slots 44*a* and 44*b* to position the platform 18 so its flat top side 18*a* is substantially horizontal when the stand is resting on its foot elements F1, F2, F3, and F4 to orient the receptacle 13 substantially vertical. The platform 18 may be welded in place. Alternately, the platform 18 is not fixed in place so that it may be detached.

Figure 7:
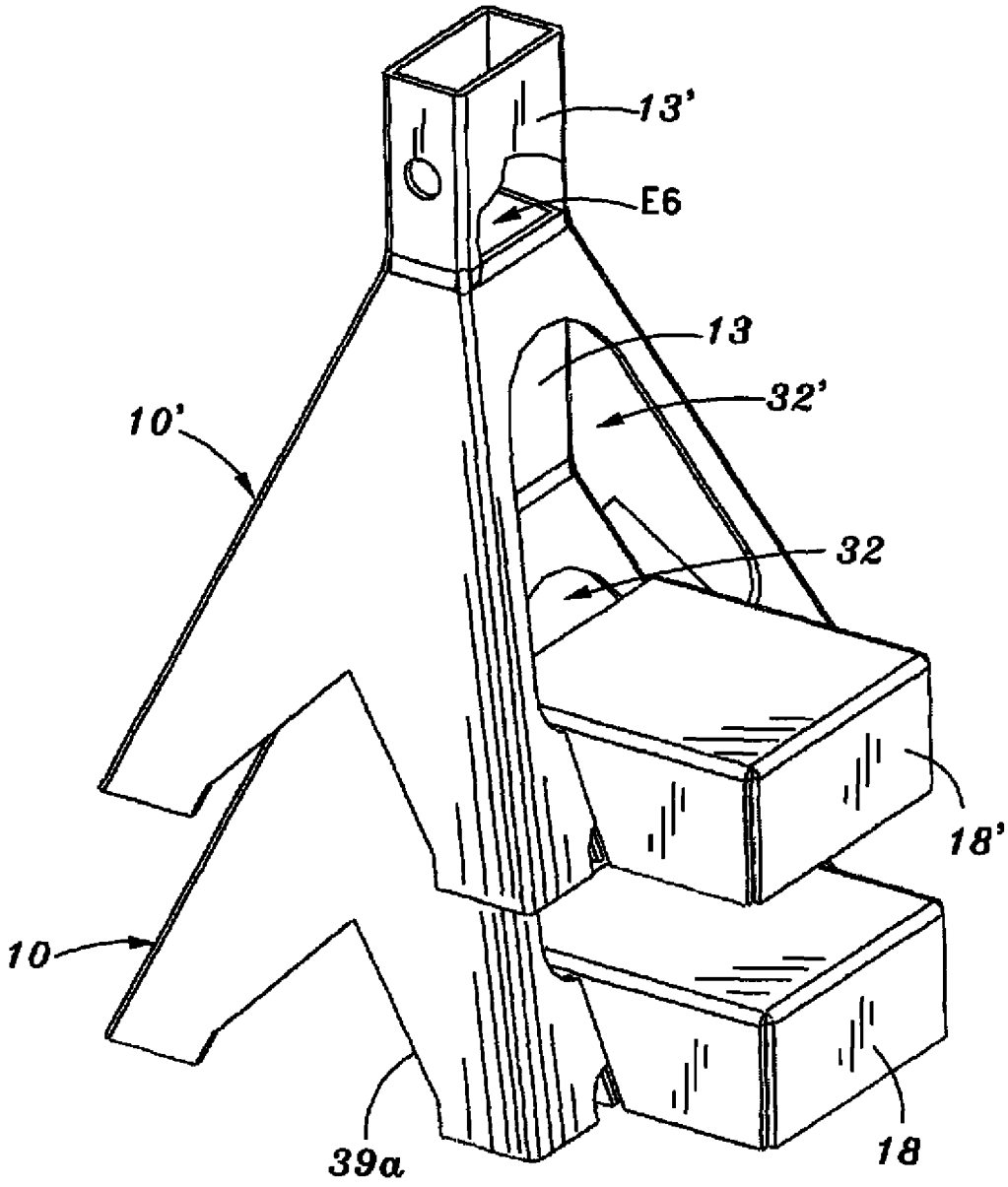
FIG. 7 is a perspective view of a pair of jack stands shown in FIG. 1 stacked together, with a section of the one of the receptacles broken away.

This configuration of the base 11 and receptacle 13 is essentially symmetrical about the centerline C. Consequently, even with their platforms attached, a plurality of the stands, with their columns and pin elements removed, may be stacked together as shown in FIG. 7. For example, a second essentially identical jack stand 10' is placed on top of the stand 10. The receptacle 13 of the stand 10 abuts an open lower end E9 of the receptacle 13' of the stand 10' and the platform 18 is directly beneath the platform 18' of the stand 10'. Thus, the stands 10 and 10' are nested together with the platforms 18 and 18' aligned. This stacking feature saves space, reducing storage and packaging costs.

Figure 4:
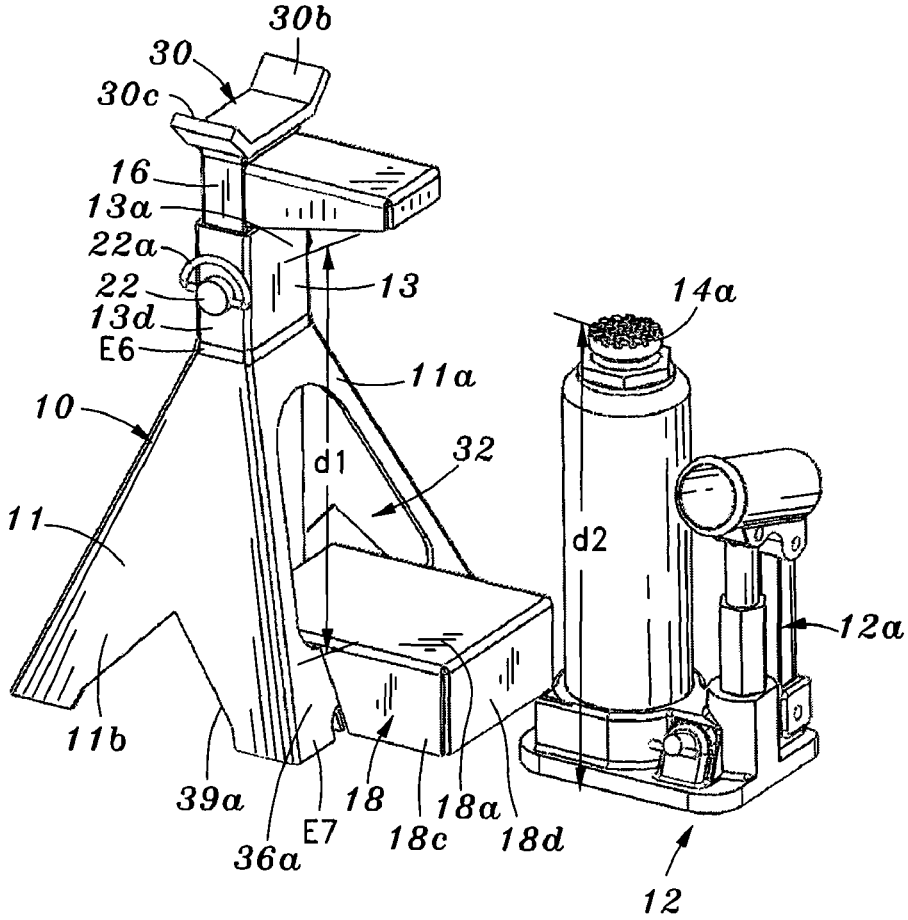
FIG. 4 is a perspective view of the jack stand shown in of FIG. 1, completely assembled with its support column inserted into the upper open end of the stand's receptacle and in a completely lowered position, and the jack next to the stand's platform.

The bottle hydraulic jack 12 is adapted to sit on the flat top side 18*a* of the platform 18 in an upright, substantially vertical orientation. The jack stand 10 is initially placed, for example, beneath a frame of an automotive vehicle and positioned with respect to the frame so that the locator member 30 will contact a vehicle's frame at a precise location that avoids any damage to the frame when the column 16 of the jack stand is elevated to support the vehicle. As shown in FIG. 4, with the column 16 of the jack stand 10 completely lowered and the piston member 14 of the jack 12 in a completely lowered position, the distance d1 between the underside 29 (FIG. 2) of the plate member 28 and the top side 18*a* of the platform 18 is essentially equal to the distance d2 between the piston head end 14*a* and the bottom of the jack 12. In other words, with the column 16 completely lowered, the distance d1 is substantially equal to the height of the vertically oriented jack 12 with its piston 14 completely lowered.

The jack 12 while on the platform 18 is at least partially received within the hollow interior 32 and is at or near the centerline C. Thus, with the jack 12 so positioned on the platform 18, the piston head end 14*a* is directly under and adjacent to the underside 29 of the plate member 28. The piston head end 14*a* engages the underside 29 of the plate member 28 as the piston 14 is elevated in response to the actuation of the piston raising and lowering mechanism 12. The upward vertical movement of the piston 14 raises the column 16, pressing the locator member 30 against the desired precise location along the frame to avoid damaging the frame.

At a selected elevation, the user manually inserts the pin element 22 into aligned openings in the column 16 and the receptacle 13. When the opening 20*a* and 20*b* in the receptacle 13 are aligned with the pair of opening 25*a*-26*a* and the pin element 22 is inserted into these four aligned openings, the column 16 is at its lowest elevation. When the opening 20*a* and 20*b* are aligned with the pair of opening 25*c*-26*c* and the pin element 22 is inserted into these four aligned openings, the column 16 is at its highest elevation as shown in FIGS. 5 and 6. When the opening 20*a* and 20*b* are aligned with the pair of opening 25*b*-26*b* and the pin element 22 is inserted into these four aligned openings, the column 16 is at an intermediate elevation between the highest and lowest elevations.

With the column 16 so elevated, the jack's piston 14 is lowered by the user actuating the piston raising and lowering mechanism 12*a*. The jack 12 may then be removed from the platform 18. Because the locator member 30 contacts the precise location along the frame that avoids bending or otherwise damaging the frame, removal of the jack has no adverse consequences. Simultaneously raising the column 16 as the jack 12 is elevated thus moves the locator member 30 into contact with the precise location along the frame. This solves the problem associate with the two step procedure of first using a jack and then, while the jack is raised and supporting a load, placing a jack stand next to the raised jack to support the load. When the user desires to remove the stand 10, the jack 12 is again placed on the platform and elevated to support the load upon removal of the pin element 22. With the pin element 22 removed the user actuates the piston raising and lowering mechanism 12*a* to lower the column 16 to the position shown in FIG. 4.

FIGS. 8 through 12

Figure 8:
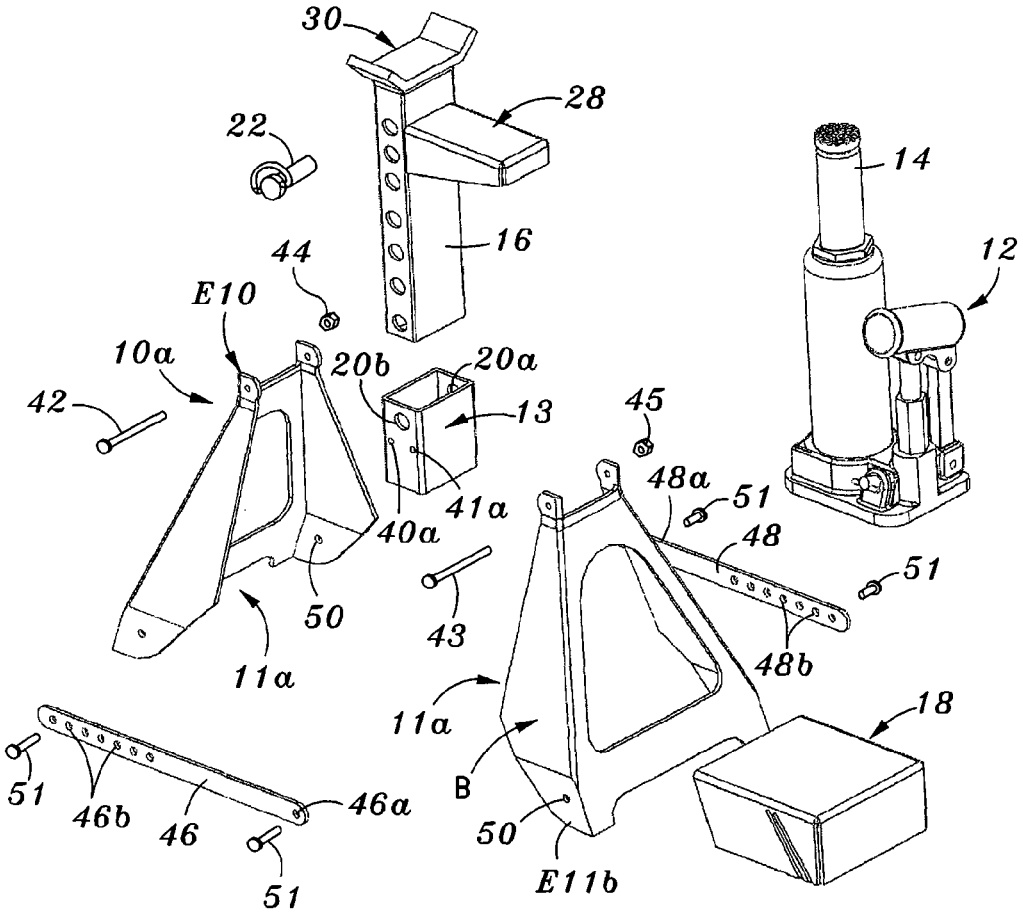
FIG. 8 is an exploded perspective view of the jack stand and jack combination of an other embodiment of this invention illustrating a jack stand comprising a pair of sections attached to pivot and lower or raise the height of the stand.
Figure 8A:
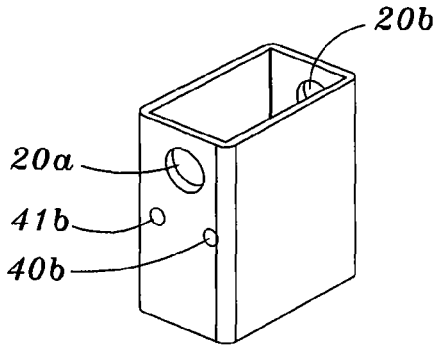
FIG. 8A is a perspective view of the receptacle used in the jack stand shown in FIG. 8 looking at the rear of the receptacle.
Figure 9:
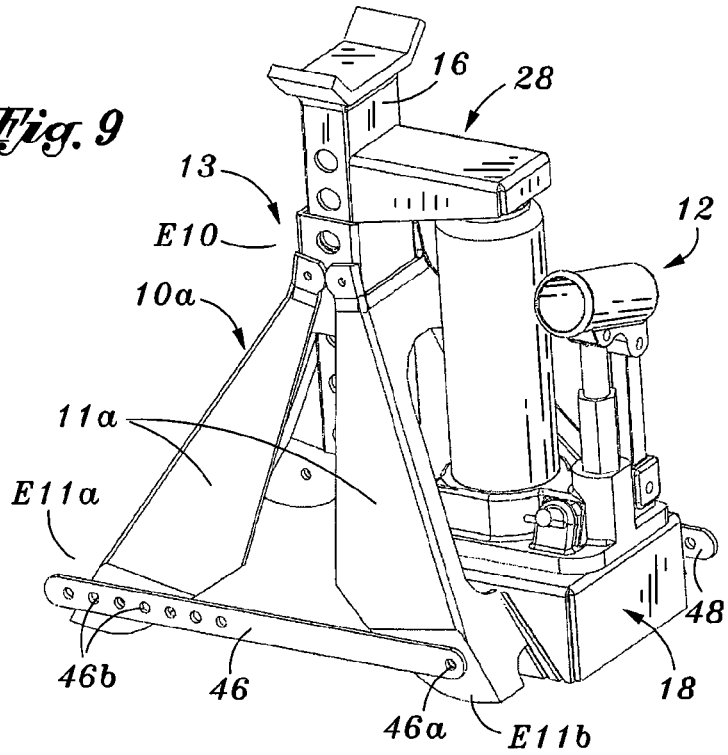
FIGS. 9 through 12 depict the jack stand and jack combination shown in FIG. 8 in different positions where.
Figure 10:
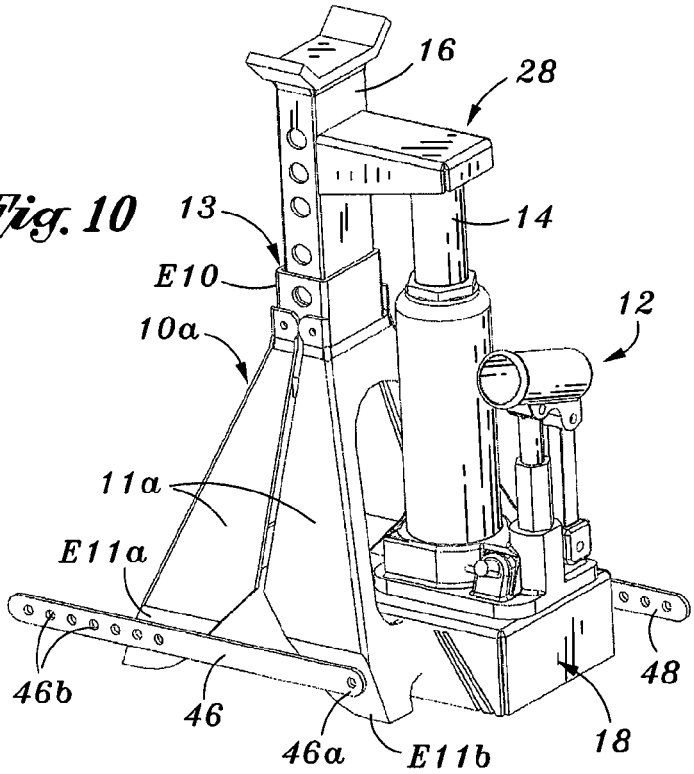
Figure 11:
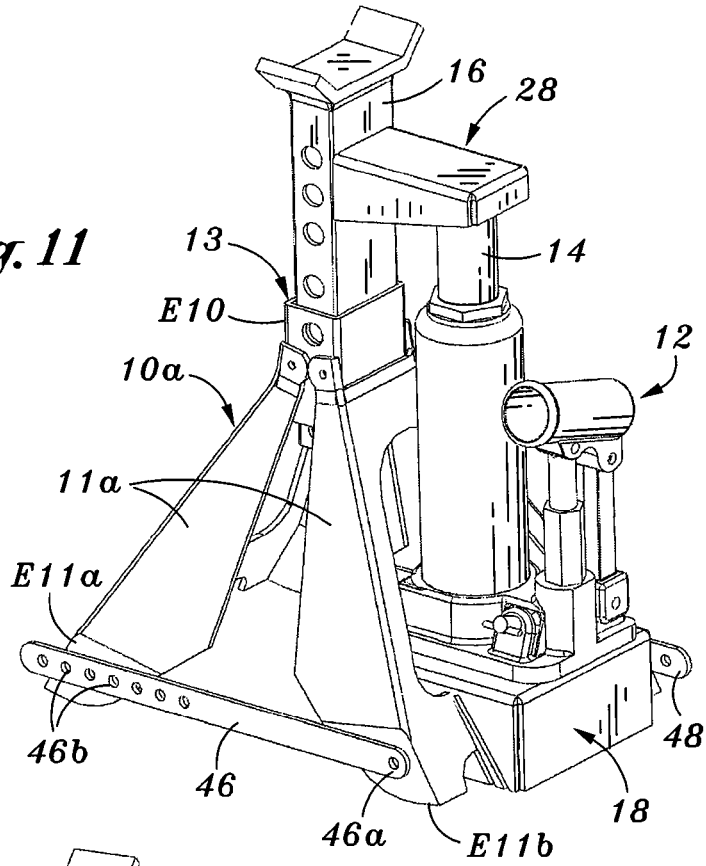
Figure 12:
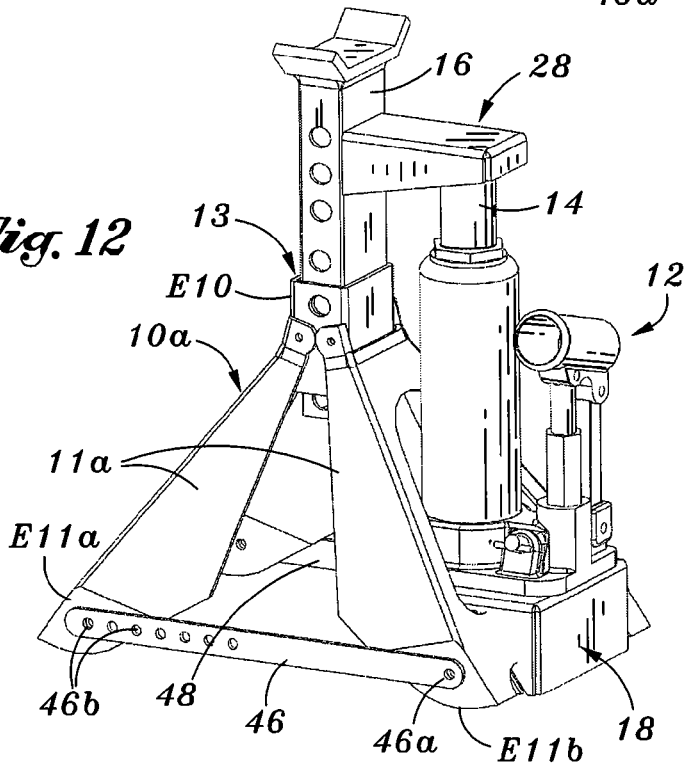
Figure 13:
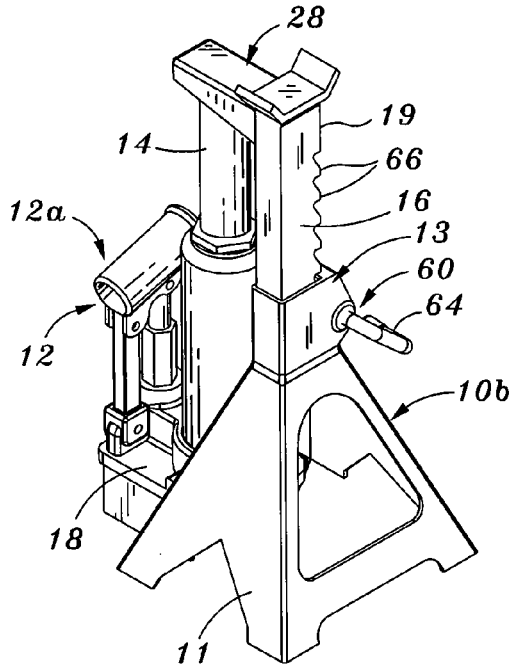
FIGS. 13 through 16 depict yet another embodiment of the jack stand and jack combination of this invention where.
Figure 14:
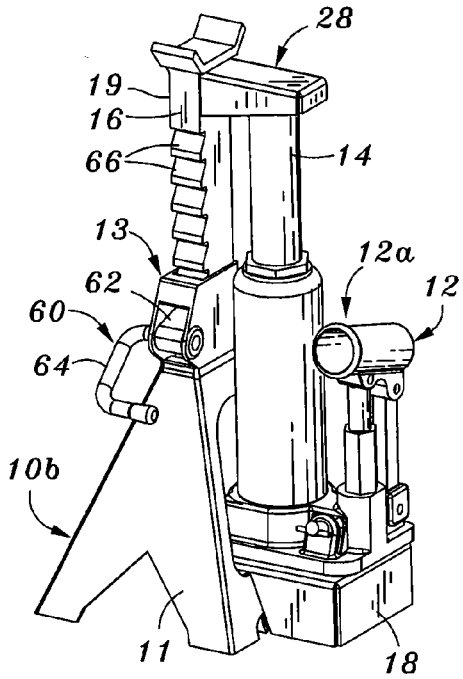
Figure 15:
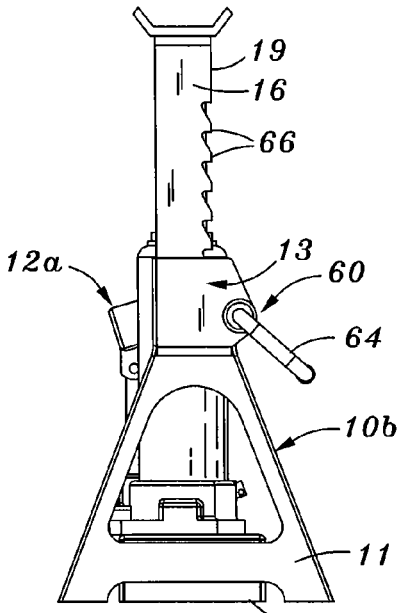

In the embodiment shown in FIGS. 8 through 12, the jack stand 10*a* is of similar pyramid shape to that of the stand 10, but its base 11*a* is bifurcated into two sections A and B, which are substantially mirror images of each other. The receptacle 13 is used with this stand 10*a* but is detachably connected by bolts 42 and 43 to the upper end E10 of the stand 10*a*. The receptacle 13 includes aligned pairs of orifices 40*a* (FIGS. 8) and 40*b* (FIG. 8A) and 41*a* (FIGS. 8) and 41*b* (FIG. 8A) beneath the aligned opening 20*a* (FIG. 8A) and 20*b* (FIG. 8). The bolt 42 extends through the aligned orifices 40*a* and 40*b* and the bolt 43 extends through the aligned orifices 41*a* and 41*b*. Nuts 44 and 45 respectively attached to the ends of the bolts 42 and 43 secure the sections A and B to the receptacle 13 in a manner allowing these sections to pivot about the bolts. The lower ends E11*a* and E11*b* of the sections A and B are thus moveable relative to each other to increase and decrease the height of the stand 10*a*. These ends E11*a* and E11*b* have apertures 50 (FIG. 8) therein that enable removable pins 51 to detachably connect a pair of braces 46 and 48 to these ends. As shown in FIGS. 9 through 12, the braces 46 and 48 are on opposite sides of the stand 10*a* and they are selectively positioned to control the distance between the lower ends E11*a* and E11*b* to either increase or decrease the height of the base 11*a*. Each of these braces 46 and 48 has at its one end a hole 46*a* and 48*a*, as the case may be, and at its opposed end a series 46*b* and 48*b*, as the case may be, of aligned equally spaced apart holes. Pins 51 (FIG. 8) are used to connect the braces 46 and 48 to the lower ends E11*a* and E11*b* of the sections A and B.

FIGS. 13 through 16

As depicted in FIGS. 13 through 16, the column 16 of the jack stand 10*b* does not have the openings 26*a*, 26*b*, and 26*c* therein that interact with the pin 22 to hold the raised column in a selected elevated position. Instead, the ratchet mechanism 60 holds the support column 16 in a selected one of plurality of different elevated positions.

Figure 16:
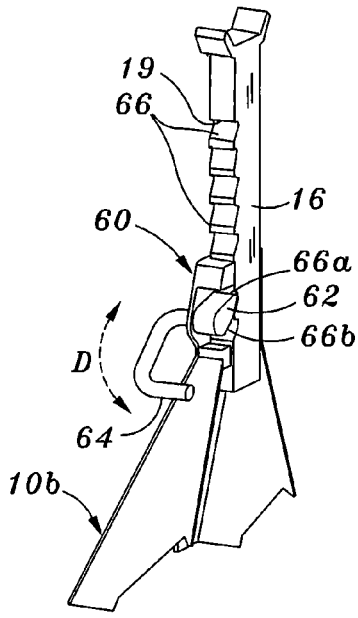
Figure 17:
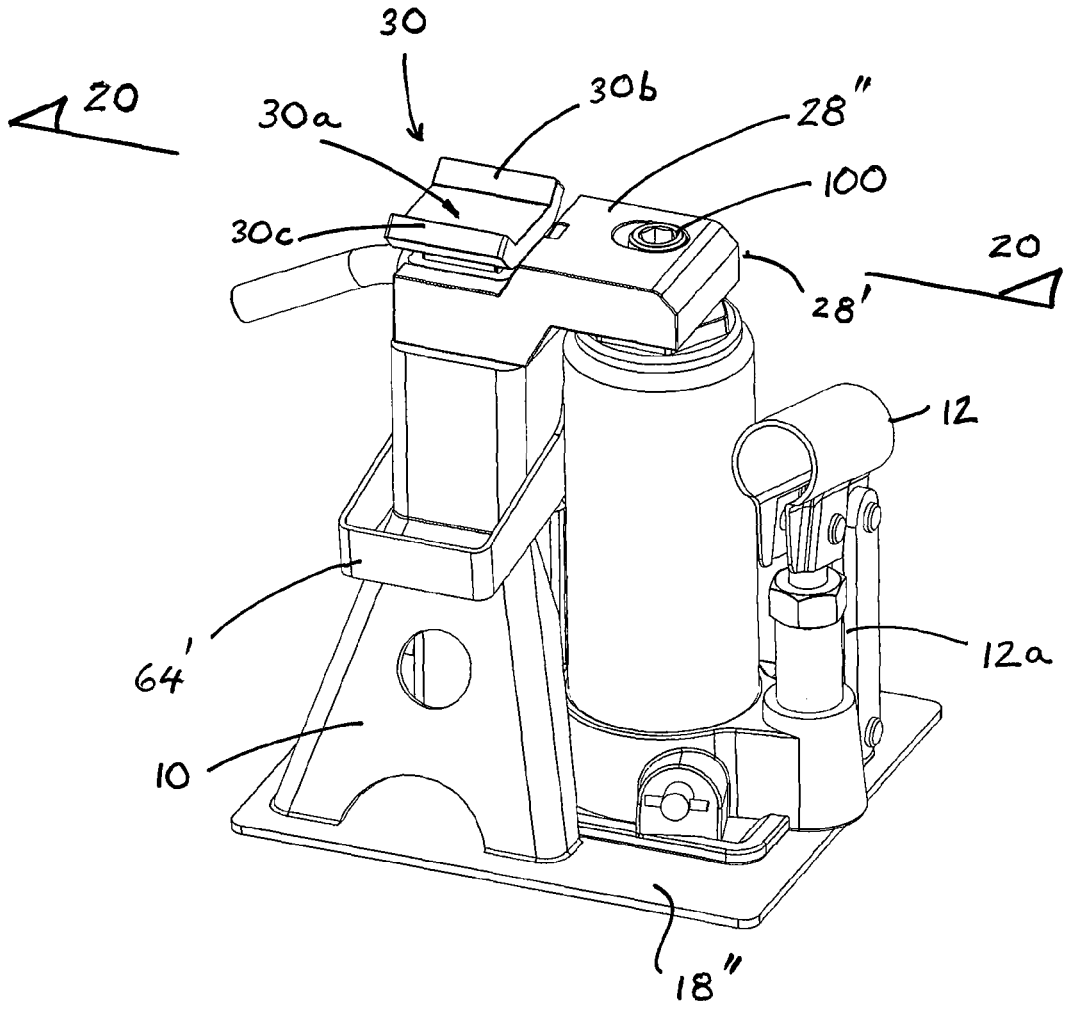
FIG. 17 is a perspective view of a further embodiment of the invention, shown in a first condition.

This ratchet mechanism 60 includes a series of teeth 66 along an outer edge 19 of the column 16 that engage a pawl 62 mounted on the receptacle 13 to rotate. A manually operated handle 64 connected to the pawl 62 controls the direction of rotation of the pawl. With the handle 64 in the position shown in solid lines, the pawl 62 may only rotate in a counterclockwise direction as shown in FIG. 16. Thus, as the piston 14 of the jack 12 is raised, the column 16 is lifted with the pawl 62 passing over the teeth until the desired elevation is attained. At this desired elevation, the pawl 62 moves between a pair of adjacent teeth 66*a* and 66*b* (FIG. 16) and engages the upper tooth 66*a* of these adjacent teeth, holding the column 16 in the selected elevated position. The jack 12 is now removed from the platform and the column 16 being held by the pawl 62 remains in the selected elevated position until lowered.

When the column 16 is to be lowered, the jack 12 is again placed on the jack platform 18, and the handle 64 is manually moved in the position shown in dotted lines in FIG. 16. This enables the pawl 62 to rotated in a clockwise direction as shown in FIG. 16. With the head end 14*a* of the piston 14 engaging the underside of the plate member 28 and the handle 64 in the dotted line position, the pawl 62 moves past the teeth 66 along the descending column 16 as it is lowered simultaneously with the piston by actuating the piston raising and lowering mechanism 12*a*.

FIGS. 17 through 20

In a further embodiment of the invention disclosed in FIGS. 17-20, a variation over the embodiment shown in FIGS. 13-16, and the previous embodiments, is disclosed to provide a further advantage to the invention. In the present embodiment, the plate member 28' is a variation of the plate member 28 of previous embodiments. In the present embodiment, a horizontal planar upper surface 28" of the plate member 28' is configured to lie in substantially the same plane as the horizontal planar upper surface of central element 30*a* of the locator member 30.

This configuration provides a major advantage because when the planar central element 30*a* of the locator member 30 is positioned under the object to be elevated, the upper surface 28" of the plate member 28' is at the same elevation as the upper surface of the central element 30*a*. This configuration means that both the central element 30*a* and the plate member 28' will initially be in contact with the object to be elevated, and will remain in contact throughout the lifting process.

Figure 18:
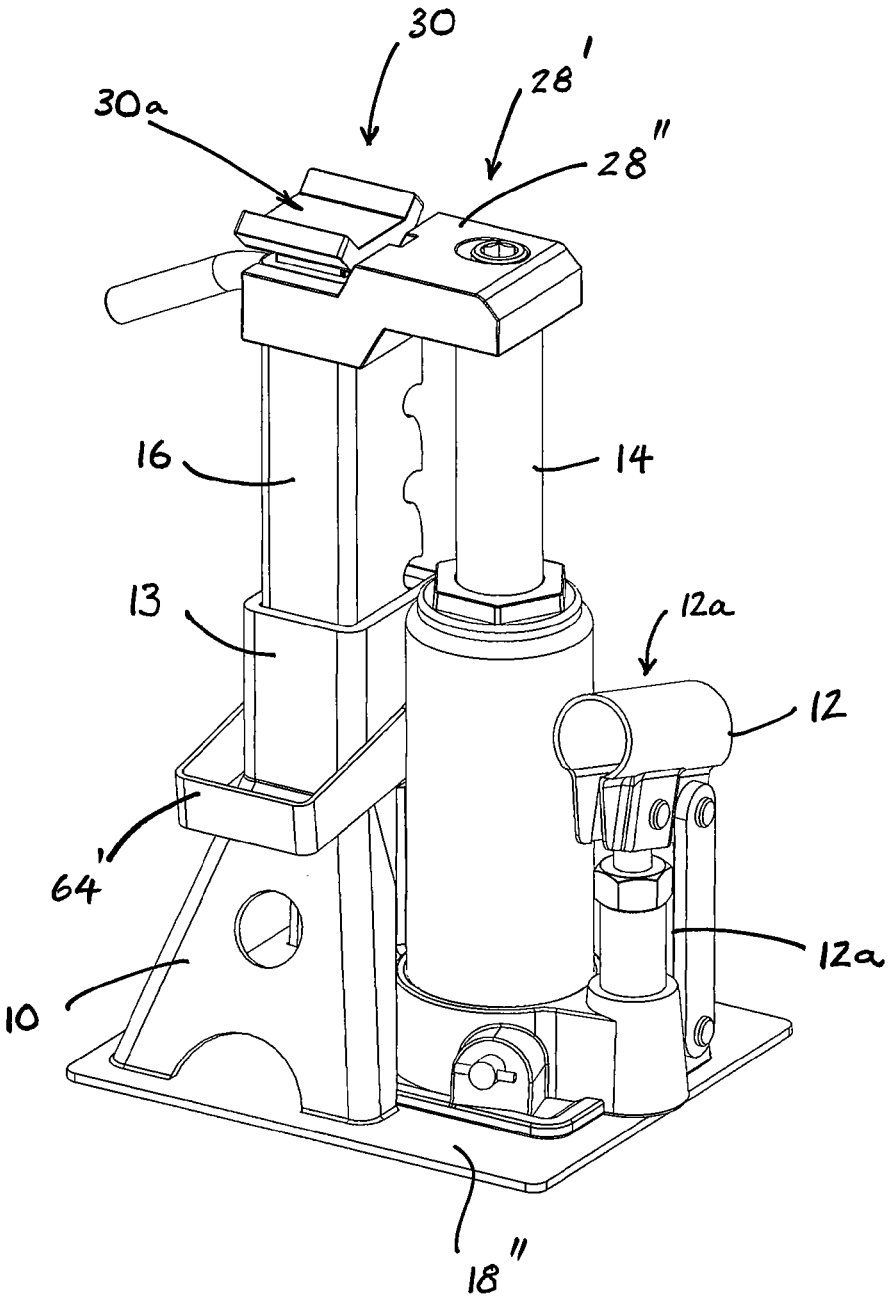
FIG. 18 is a perspective view of the embodiment in FIG. 17, shown in a second condition.

Thus, a first advantage arises because when the piston 14 of the bottle jack 12 is activated to elevate the plate member 28', the load force from the piston 14 travels directly upwards by compressive force through the plate member 28' and into the object being elevated, while also pulling the locator member 30 and its support column upwards in unison, as send in FIG. 18. This arrangement avoids a problem present in the previous embodiment of the plate member 28. That plate member 28 is positioned lower than the upper surface of the central element 30*a*, so that the load from the piston 14 travels into the plate member 28 and then sideways into support column 16 and then into the locator member 30 before the load passes into the elevated object. As will be appreciated by one of ordinary skill, such a sideways movement of load through a structure may generate considerable shear forces (and thus tensile forces) in the plate member 28 of the previous embodiment, which may tend to cause the connection between plate member 28 and support column 16 to fail if any defects such as cracks are present in the metallurgy of the connection. The presently configured plate member 28' on the other hand, avoids shear forces being developed in the connection because the load force travels vertically from the piston 14, through the plate member 28' by compression, and into the object being elevated.

In further preferred aspects of this embodiment of the invention, the bottle jack 12 of the combination is removable from a platform 18" of this embodiment, upon which the base of the jack stand is configured to rest. In this regard, the bottle jack may be temporarily affixed to the platform by conventional attachment means such as a clamp or screw, by which the temporary affixation may be released to allow the bottle jack to be removed in relation to the jack stand. This aspect provides the further advantage that, once the object has been elevated to the desired elevation, the hydraulic pressure of the bottle jack may be released, thereby lowering the piston. This in turn results in the gravitational load being transferred to the locator member 30 and its support column 16 without any movement of the elevated object. Thereafter, the bottle jack 12 may be removed, and may be used in conjunction with other jack stands of similar configuration, thereby providing an overall economy where more than one jack stand is required in a workshop environment. In a yet further aspect, the piston 14 may be temporarily secured to the plate member 28' by a nut 100 which is removable by a user between operations of elevating an object.

Figure 19:
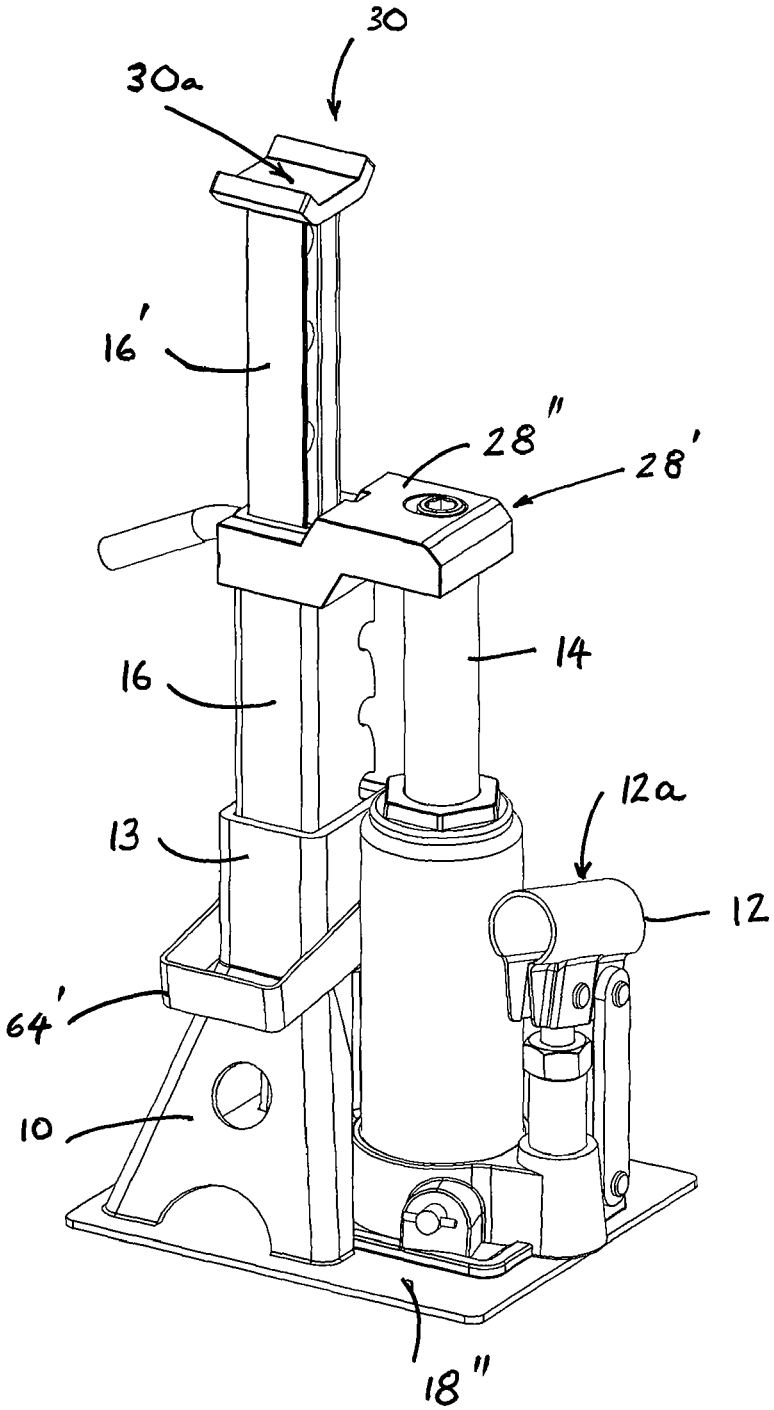
FIG. 19 is a perspective view of the embodiment in FIG. 17, shown in a third condition.
Figure 20:
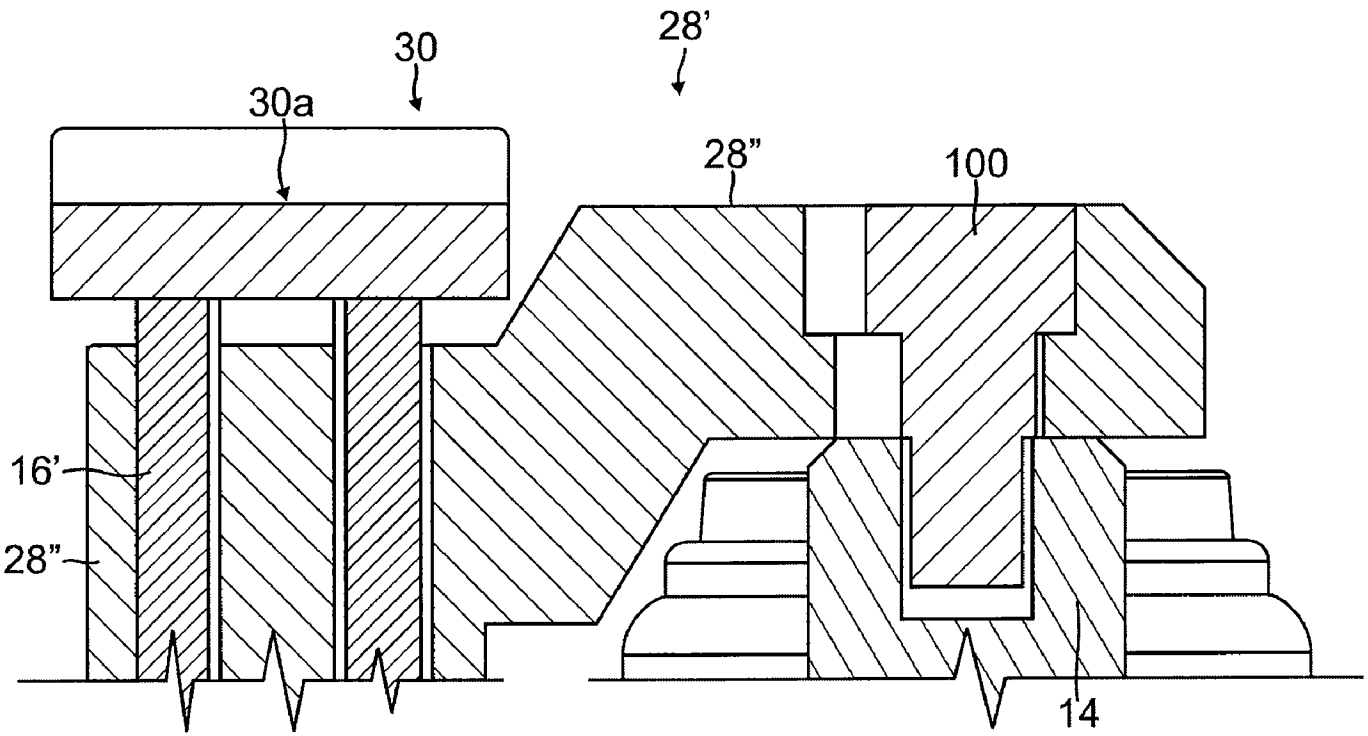
FIG. 20 is a partial sectional view taken substantially along the line 20-20 in FIG. 17.

In yet a further aspect of the present embodiment, the locator member 30 may be separately elevated in relation to the support column 16, and in relation to the plate member 28'. This may be accomplished by elevating the locator member 30 on top of an inner support column 16' which telescopes from within the main support column 16 as seen in FIG. 19. It will be appreciated that this aspect allows a user to elevate an object that is positioned higher from the ground than the locator member 30 could otherwise reach. In other words, the telescoping inner support column 16' gives the jack stand added upward reach. However, when used in this way, the previously mentioned advantage (provided by the plate member 28' being co-planar with the central element 30*a* of the locator member 30) is lost. Nevertheless, as will be appreciated, this aspect provides greater overall versatility for the present embodiment of the invention, because a user has a choice between which advantage to select.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A jack stand in combination with a hydraulic jack comprising:

a jack stand having:

a platform for providing stable support;

a base attached to the platform, the base defining a receptacle configured to slidingly receive a column;

a column having an upper end and a lower end, the lower end slidingly received within the receptacle;

a locator member for precise location under an object to be lifted, the locator member being attached to the upper end of the column and including a first planar horizontal surface for contact with the object to be lifted;

a plate member connected to the upper end of the column, the plate member extending substantially at a right angle to the column and including a second planar horizontal surface for contact with the object to be lifted;

wherein the first planar horizontal surface is substantially co-planar with the second planar horizontal surface; and a hydraulic jack positioned on the platform, the hydraulic jack having:

an elongate piston movable upwardly in relation to the hydraulic jack for elevating a load, the piston having a terminal end, wherein, the hydraulic jack is positioned adjacent the jack stand such that the elongate piston is positioned alongside of and parallel with the elongate column; and the terminal end of the piston is positioned in contact with a lower surface of the plate member, whereby, when the piston is moved upwardly under a load in relation to the hydraulic jack, the plate member is moved upwardly to elevate the load, the column is moved upwardly, and the locator member is moved upwardly in unison with the plate member;

wherein, the jack stand further includes a means for mechanically holding the column in a selected one of a plurality of different elevated positions in relation to the base; and further wherein, the hydraulic jack is removable from the platform when the column is being held in an elevated position by the means for mechanically holding the column.

2. The combination of claim 1, wherein the means for mechanically holding the column in relation to the base includes a pin manually insertable into aligned holes in the base and in the column.

3. The combination of claim 1, wherein the means for mechanically holding the column in relation to the base includes a ratchet mechanism having teeth on the column configured to engage a pawl mounted on the base.

4. The combination of claim 1, wherein the piston is connectable to the plate member via a removable connector.

* * * * *